US005819328A

United States Patent [19]

Lewis

[11] Patent Number: 5,819,328

[45] Date of Patent: Oct. 13, 1998

[54] HYDROSTATIC DRAIN PLUG

[75] Inventor: Mitchell Lee Lewis, Cairns, Australia

[73] Assignee: Udo Jattke, Queensland, Australia

[21] Appl. No.: 342,842

[22] Filed: Nov. 21, 1994

Related U.S. Application Data

[63] Continuation-in-part of Ser. No. 941,122, Oct. 30, 1992, abandoned.

[30] Foreign Application Priority Data

May 4, 1990 [AU] Australia ..... PJ9974

[51] Int. Cl.[6] ..... A47K 1/14

[52] U.S. Cl. ..... 4/295; 137/42

[58] Field of Search ..... 4/286, 287, 293, 4/295; 137/42, 44, 403, 542

[56] References Cited

U.S. PATENT DOCUMENTS

| | | |
|---|---|---|
| 1,467,965 | 9/1923 | Watrous . |
| 1,975,865 | 10/1934 | Rabinovich . |
| 2,337,331 | 12/1943 | Kirschner . |
| 2,590,656 | 3/1952 | Schnebel . |
| 3,542,057 | 11/1970 | Staiano . |
| 4,084,609 | 4/1978 | Johnson . |
| 4,143,432 | 3/1979 | Deken . |
| 4,276,662 | 7/1981 | Young . |
| 4,597,112 | 7/1986 | Cuschera . |

FOREIGN PATENT DOCUMENTS

| | | |
|---|---|---|
| 1244552 | 6/1952 | Australia . |
| 163449 | 6/1955 | Australia . |
| 213319 | 3/1958 | Australia . |
| 6615781 | 1/1981 | Australia . |
| 875802 | 7/1971 | Canada . |
| 0288731 | 11/1988 | European Pat. Off. . |
| 762398 | 4/1934 | France . |
| 2233383 | 7/1972 | Germany . |
| 0062652 | 8/1924 | Sweden . |
| 1180676 | 2/1970 | United Kingdom . |

*Primary Examiner*—Charles E. Phillips
*Attorney, Agent, or Firm*—Renner, Otto, Biosselle & Sklar, P.L.L.

[57] ABSTRACT

A hydrostatic drain plug/outlet assembly comprises a hollow body (1) with an inlet port and an outlet port for connection to a fluid conduit. A slidable valve member (6) is movable between a locked open position and a locked closed position via an intermediate position at which the valve member (6) is urged into sealing engagement with a sealing member (3) by a spring (21) which supports a hydrostatic pressure of predetermined magnitude beyond which excess hydrostatic pressure is relieved by the valve member to prevent fluid overflow in a vessel. The valve member is moved between the locked open position and the locked closed position by rotation of valve member (6).

9 Claims, 3 Drawing Sheets

HYDROSTATIC DRAIN PLUG

BACKGROUND

This application is a continuation-in-part of co-pending patent application Ser. No. 07/941122 now abandoned.

FIELD OF THE INVENTION

THIS INVENTION is concerned with improved drain or waste plugs for liquid containing vessels.

The invention is particularly, although not exclusively concerned with, drain or waste plugs (hereinafter referred to generally as drain plugs) for use in association with waste outlets of hand basins, sinks, baths, spa baths, floor drains and the like in domestic and commercial buildings, laboratories and the like.

PRIOR ART

The simplest forms of drain plug in general use comprise a rigid or flexible frusto-conical plug adapted to engage in a frusto-conical neck of complementary shape in the neck of a waste outlet or alternatively, a plug with a flexible flange adapted to engage an annular rim of a waste outlet.

While generally effective for their purpose in providing a means to retain a body of liquid within a vessel, these plugs suffer a number of disadvantages. Both types of plugs referred to above form a seal under the pressure of a head of water in the vessel and as the depth of water increases, the effort required to remove the plug increases greatly. For children or aged or infirm persons, this can be most inconvenient and in some cases, quite dangerous.

Furthermore, if attention is distracted whilst filling a bath, hand basin or like vessels, the vessel may be allowed to overflow with disastrous consequences to carpets, furnishings and building structures both in domestic dwellings and multi-storey dwellings such as hotels, apartments, etc.

A significant disadvantage associated with plugs of the above type is that generally they are not captive and thus are easily lost, misplaced or, in the case of hotels and the like, stolen thereby necessitating costly frequent replacements. Although it is possible to make a drain plug captive by attachment or a cord or chain, this is not always convenient and can be unsightly and difficult to clean.

There have been many attempts to overcome the disadvantages associated with prior art drain plugs. Exemplary of these are Australian Patent Applications 12445/52 and 36335/89, Australian Patent No. 213319, International Patent Application No. PCT/GB85/00345 (WO86/01100) and Australian Patent Application No. 66157/81.

Patent Application No. 12445/52 concerns a waste outlet having a rotatable plate with apertures selectively alignable with apertures in the body of the outlet. The plate is rotatable to open or close the waste outlet. This device is difficult and inconvenient to operate, suffers from poor liquid sealing capacity and an exposed spring mechanism provides a lint trap leading ultimately to poor drainage and blockage.

Patent Application No. 36335/89 describes a device similar to that of Patent Application No. 12445/52 but comprises a removable plug assembly which is easily lost or stolen.

Australian Patent No. 213319 describes a captive plug/waste outlet combination wherein sealing engagement of the plug is achieved by rotating the plug on a threaded shaft to raise or lower the plug relative to the mouth of the outlet. This device suffers from poor drainage, entrapment of lint and, in the open position, protrudes above the surface of the outlet thereby causing the potential for injury in a bath or the like.

Patent Application No. PCT/GB85/00345 describes a waste outlet comprising a cover plate attached to one end of a shaft and a plug attached at the other end of the shaft. The plug is urged into sealing engagement with an outlet aperture against a spring biassing means by pushing downwardly on the cover plate and rotating through 90° by means of a bayonet coupling. This particular device is considered to be particularly prone to blockages due to entrapment of lint in both upper and lower spring mechanisms and such blockages would require a relatively difficult dismantling to clear the blockage.

Each of the above types of plug/outlet combination are concerned with a plug which is subjected to hydrostatic pressure which enhances the liquid seal and thus increases the difficulty of disengaging the plug under a head of water.

Australian Patent Application No. 66157/81 describes an hydraulically actuated plug which seals against the hydrostatic pressure of a head of water. Apart from requiring an extremely expensive installation to permit selective application of mains water pressure to actuate the plug, the system is prone to water leakages in the pressure actuation system, blockages and poor sealing in the presence of foreign matter.

Apart from Patent Application No. 36335/89, all of the aforementioned prior art waste plug/outlet combinations are subject to blockage by lint entrapment and require either removal of the waste pipe or complete dismantling of the plug/outlet combination for cleaning purposes.

Other waste plug/outlet combinations are described in German Patent No. 2,233,383, French Patent No. 762,398, U.S. Pat. No. 4,597,112, U.S. Pat. No. 1,467,965, U.S. Pat. No. 1,975,865, U.S. Pat. No. 443,432, U.S. Pat. No. 2,337,331, U.S. Pat. No. 3,542,057, U.S. Pat. No. 2,590,656, Swedish patent No. 62,652 and German Patent No. 2,263,662.

Of these other prior art waste plug/outlet combinations, only German Patent No. 2,263,662, U.S. Pat. No. 1,975,865, U.S. Pat. No. 2,590,656 and U.S. Pat. No. 3,542,057 are hydrostatically actuable valve mechanisms.

U.S. Pat. No. 2,590,656 is concerned with a safety valve which automatically release pressure in a fluid line carrying relatively large amounts of suspended solid matter when a predetermined line pressure is exceeded. The valve is not selectively operable at pressures lower than the predetermined bleed or overflow line pressure.

German Patent No. 2,263,662 describes a plug for a conventional waste outlet, the plug having a pressure relief valve actuable under hydrostatic pressure to maintain a constant head in a container such as a bathtub or basin. While this device overcomes some of the prior art problems of overflow, it does not overcome the typical problems associated with accumulation of lint and foreign matter (a potential health hazard) which requires frequent maintenance and is otherwise not readily held captive to prevent thefts. Yet another disadvantage of this plug is that in order to empty the bathtub or hand basin in which the plug is fitted, either the plug assembly as a whole must be removed against the head of water retained in the vessel or a user must manually push the relief valve open and hold it in the open position until the vessel has drained or the head of retained water has decreased sufficiently to allow removal of the plug assembly. This is very inconvenient to young persons and elderly or infirm persons.

U.S. Pat. No. 1,975,865 describes a hydrostatic dump valve which operates to dump the entire contents of a vessel when a predetermined hydrostatic pressure is exceeded.

Apart from being inconvenient for use in a bathtub or hand basin in terms of discharging the entire contents when the valve is actuated, this apparatus also provides a number of traps for debris as well as lint and hair. In addition, an annular well on the upper surface of a flexible valve diaphragm retains liquid waste at all times and as such is grossly unhygienic.

U.S. Pat. No. 3,542,057 describes an upright hollow cylindrical plug body with a tapered frusto-conical threaded lower end to engage into an internally threaded opening of a drain in a drain trap or sump. A special wrench is described for installation and removal of the plug body from the drain opening. While one embodiment of this reference describes a valve assembly removable from the plug body for cleaning, the location of the valve assembly at the base of the plug body also requires the use of a special tool to remove the plug assembly.

A major deficiency with this type of drain plug valve is that the upstanding plug body prevents the complete drainage of liquid from a vessel in which the plug valve is located. Moreover, the provision of an apertured strainer plate and an exposed spring biassing arrangement above the valve assembly is such that accumulation of debris, lint and hair would readily interfere with the hydrostatic operation of the valve leading to early clogging of the strainer or jamming of the valve in a closed or open position.

BRIEF SUMMARY AND OBJECTS OF THE INVENTION

It is an aim of the present invention to overcome or alleviate the problems of prior art waste plug/outlet combinations and to provide a novel waste plug/outlet with additional advantages.

According to the invention, there is provided a hydrostatic waste plug fitting for a drain opening in a bathtub or hand basin, said fitting comprising:

hollow body having an inlet end and an outlet end, the outlet end being adapted for connection to a waste conduit;

a valve seat member secured within said hollow body, said valve seat member defining a substantially unobstructed aperture;

a valve support member within said hollow body;

a support shaft slidably mounted in said valve support member;

a valve member attached to said support shaft;

a resilient biassing spring to urge said valve member to a normally closed position against said valve seat member; and locking means to selectively lock said valve member in an open position;

said valve member, in an unlocked condition, being movable under the influence of a predetermined hydrostatic pressure between a closed position and an open position, and movable under the influence of said biassing spring between an open position and a closed position after reduction of said predetermined hydrostatic pressure to maintain a predetermined level of liquid in the bathtub or hand basin; and said valve seat member, valve member, support shaft, valve support member and biassing spring being removable from said hollow body via said inlet end;

said waste plug fitting characterised in that when said valve member is in an open position, a substantially unobstructed fluid pathway is provided between said inlet end and said outlet end to enable debris to be flushed therethrough.

If required, said apparatus may additionally or alternatively include locking means to selectively lock said valve member in a closed position.

The sealing means may comprise any suitable means which, in association with said valve member, forms a liquid tight seal to prevent ingress of liquid into said inlet port.

Suitably, the sealing means is releasably attachable to said body portion to enable insertion to or withdrawal from the interior of said body portion of said valve member.

Preferably, said sealing means comprises a sealing surface which diverges inwardly of said body portion.

Suitably, said sealing surface comprises a frusto-conical surface adapted to engage a complementary surface on said valve member.

Preferably, said biassing means comprises a compression spring operative between said movable valve member and valve support member associated with said body portion.

If required, said biassing means may be adjustable to selectively vary the biassing force which urges said valve member towards a closed position.

Suitably, a cover means is associated with said biassing means to prevent, in use, contact between said biassing means and foreign matter entering said inlet port.

The valve means suitably comprises a rotatable member having a circular head portion with a frusto-conical sealing surface and a central valve shaft rotatably mounted in said valve support member.

Preferably, said locking means comprises one or more projections extending perpendicularly to said valve shaft.

The locking means suitably includes one or more slotted recesses associated with said valve support member to receive a respective projection to selectively retain said valve member in an open or closed position.

The locking means may alternatively or additionally comprise one or more ramped surfaces associated with said valve support member to engage said one or more projections to guide said valve member into a locked open and/or a locked closed position upon rotation of said valve member.

Preferably, grip means is provided on a normally upper surface of said valve member to facilitate rotation thereof.

Suitably, said valve member is selectively movable between a locked open position and a locked closed position via an intermediate unlocked position wherein said valve member is urged into sealing engagement with said sealing means by biassing force of predetermined magnitude.

If required, said biassing means may comprise a compressible fluid or an incompressible fluid associated with a pressure accumulation means.

BRIEF DESCRIPTION OF THE DRAWINGS

In order that the invention may be more readily understood, reference is now made to preferred embodiments of the invention illustrated in the accompanying drawings, in which.

DETAILED DESCRIPTION OF THE ILLUSTRATED EMBODIMENTS

Figure 1:
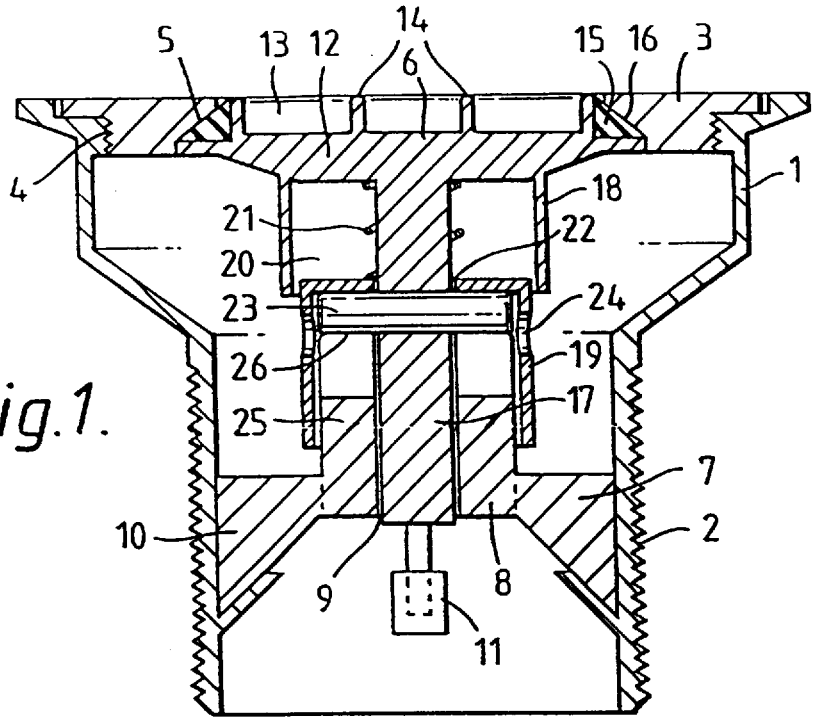
FIG. 1 is a cross sectional view of a drain plug/waste outlet apparatus in the closed position.
Figure 2:
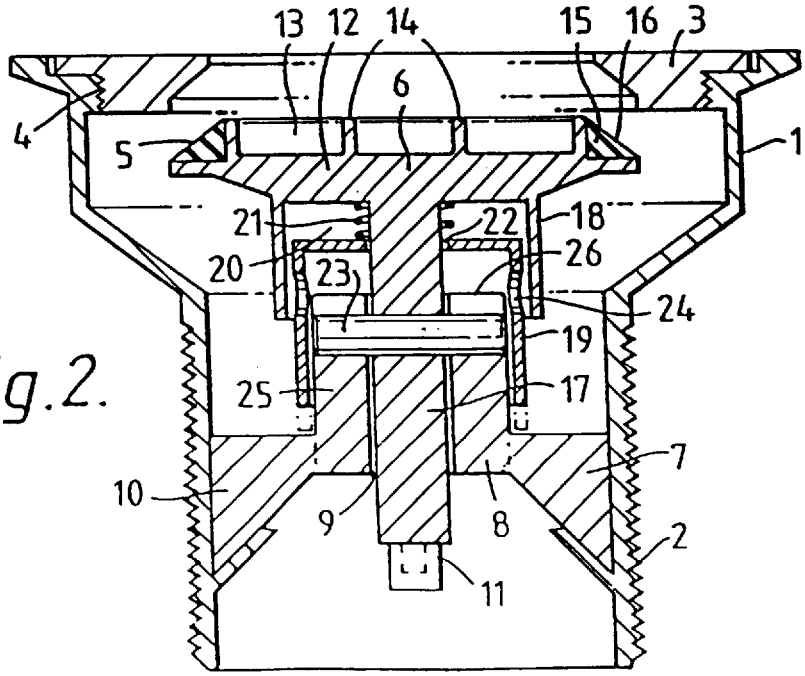
FIG. 2 shows the apparatus of FIG. 1 in an open position.
Figure 3:
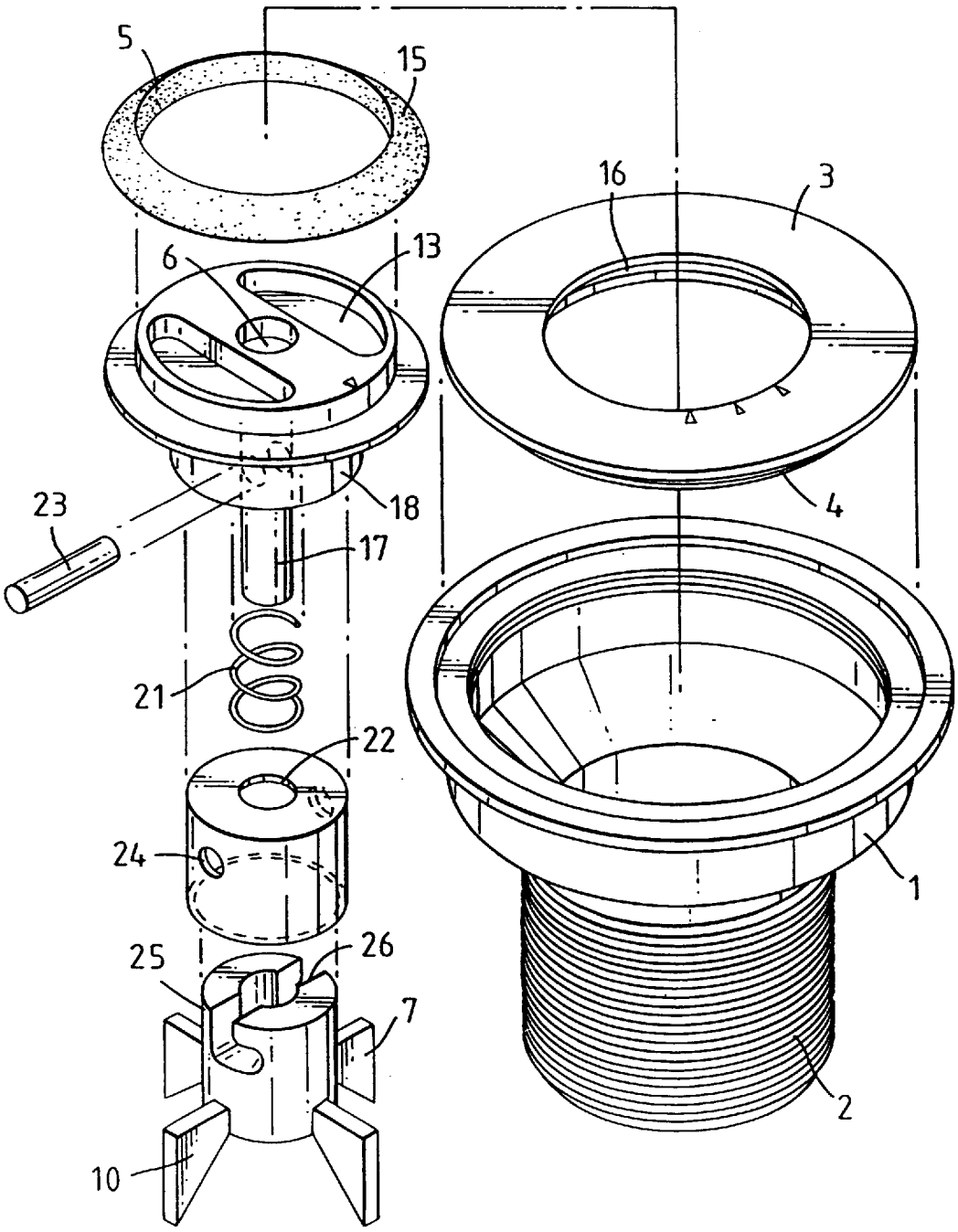
FIG. 3 shows the apparatus of FIGS. 1 and 2 in an exploded perspective view.

Referring to FIGS. 1–3, the drain plug/waste outlet comprises a body 1 having an externally threaded portion 2 to facilitate connection to a waste conduit (not shown). Removably located in the upper opening or mouth of body 1 is an annular sealing member 3 which engages an internally threaded portion 4 in the mouth of body 1. About the inner periphery of sealing member 3 is a frusto-conical sealing face 5 which diverges inwardly of body 1.

Located within the hollow interior of body 1 is a valve member 6 slidably located in a valve support member 7. Valve support member 7 comprises a central portion 8 with an aperture 9 in which the valve member 6 is able to slide in a reciprocatory fashion. Extending radially from central portion 8 are spaced legs 10 which located in recesses 11 formed on the inner wall of body 1.

Valve member 6 comprises a circular cap 12 with a recess 13 in its upper surface. Within recess 13 is a finger grip portion 14 to facilitate rotation of valve member 6. About the periphery of cap 12 is located resilient seal 15 having a frusto-conical sealing surface 16 complementary to sealing surface 5 on sealing member 3. Depending from the lower side of cap 12 is a cylindrical shaft 17 which slidably locates in aperture 9 in valve support member 7. Also depending from the lower side of cap 12 is a circular wall 18 which in conjunction with hollow cylindrical shroud 19, forms a substantially sealed enclosure 20 housing a compression coil spring 21.

Shroud 19 has a central aperture 22 through which shaft 17 is able to slide. A cylindrical pin 23 is inserted through an aperture in shaft 17 via opposed apertures 24 in shroud 19.

Located within shroud 19 and between pin 23 and the central portion 8 of valve support member 7 is an annular boss 25 with opposed "bayonet" slots 26 (shown in FIG. 3) having curved or tapered pin engagement surfaces.

FIG. 1 shows the drain plug/waste outlet apparatus in a closed position whilst FIG. 2 shows the apparatus in an open position wherein a substantially unobstructed fluid pathway is provided between the upper and lower openings of body 1.

The operation of the apparatus according to the invention will now be described with reference to FIGS. 1–3.

The drain plug/waste outlet illustrated in FIGS. 1–3 is readily fitted to sinks, hand basins, baths, showers, spa baths and the like in a conventional manner. As shown in FIG. 3, cap 12 is rotatable between an "open" position through an intermediate "fill" position to a "closed" position.

In the closed position shown in FIG. 1, pin 23 rests upon the upper surface 26 of boss 25 and urges the resilient seal 15 into sealing engagement with sealing face 5 of sealing member 3 to prevent egress of water or the like through the waste outlet body 1.

By rotating the cap 12 to the intermediate "fill" position, pin 23 is aligned with the upright portion of slots 26 whereby the valve member 6 may be pushed downwardly against the restoring force of spring 21. By selecting a spring 21 having a predetermined restoring force sufficient to support a given head of fluid pressure, the apparatus provides a very convenient overflow prevention means for liquid container such as laundry tubs, hand basins, baths, etc. When the liquid depth reaches a predetermined "safe" level, the pressure of the head of liquid above valve member 6 beings to exceed the restoring force of spring 21 and thus allows excess fluid to escape via the hollow interior of body 1. The apparatus according to the invention may be provided with a plurality of "standard" springs 21, each having a restoring force equivalent to a predetermined liquid depth in, say, a hand basin, a laundry tub and a bath. Alternatively, spring compression means (not shown) in the form of removable spacer or a threaded collar on shaft 17 may be provided to selectively vary the head of liquid able to be supported by the apparatus in the "fill" position.

To empty the liquid container to which the apparatus is fitted, cap 12 is pushed downwardly against the restoring force of spring 21 and then rotated to enable the free ends of pin 23 to enter the laterally extending portion of slots 26 in boss 25 in a cam-like action, the respective tapered surfaces of the pin and the curved slot portion guiding the pin into a locking position thereby retaining the valve member 6 in an open position.

While it will be readily apparent to a skilled addressee that the apparatus according to the invention is readily assembled and disassembled for manufacture, installation and maintenance purposes, there are other significant advantages.

The configuration of the plug/outlet assembly permits a more rapid evacuation of liquid due to lack of restrictions in the flow path and also due to the ready formation of a "whirlpool" effect at the mouth of the outlet.

Furthermore, the absence of a strainer and the shrouding of internal components which otherwise entrap lint, hair and other foreign matter, reduces costly maintenance due to blockages and wear on movable components. In the event that maintenance is required, the entire valve assembly is accessible and removable by removing sealing member 3 without the necessity for disconnecting the waste conduit attached to the apparatus.

Figure 4:
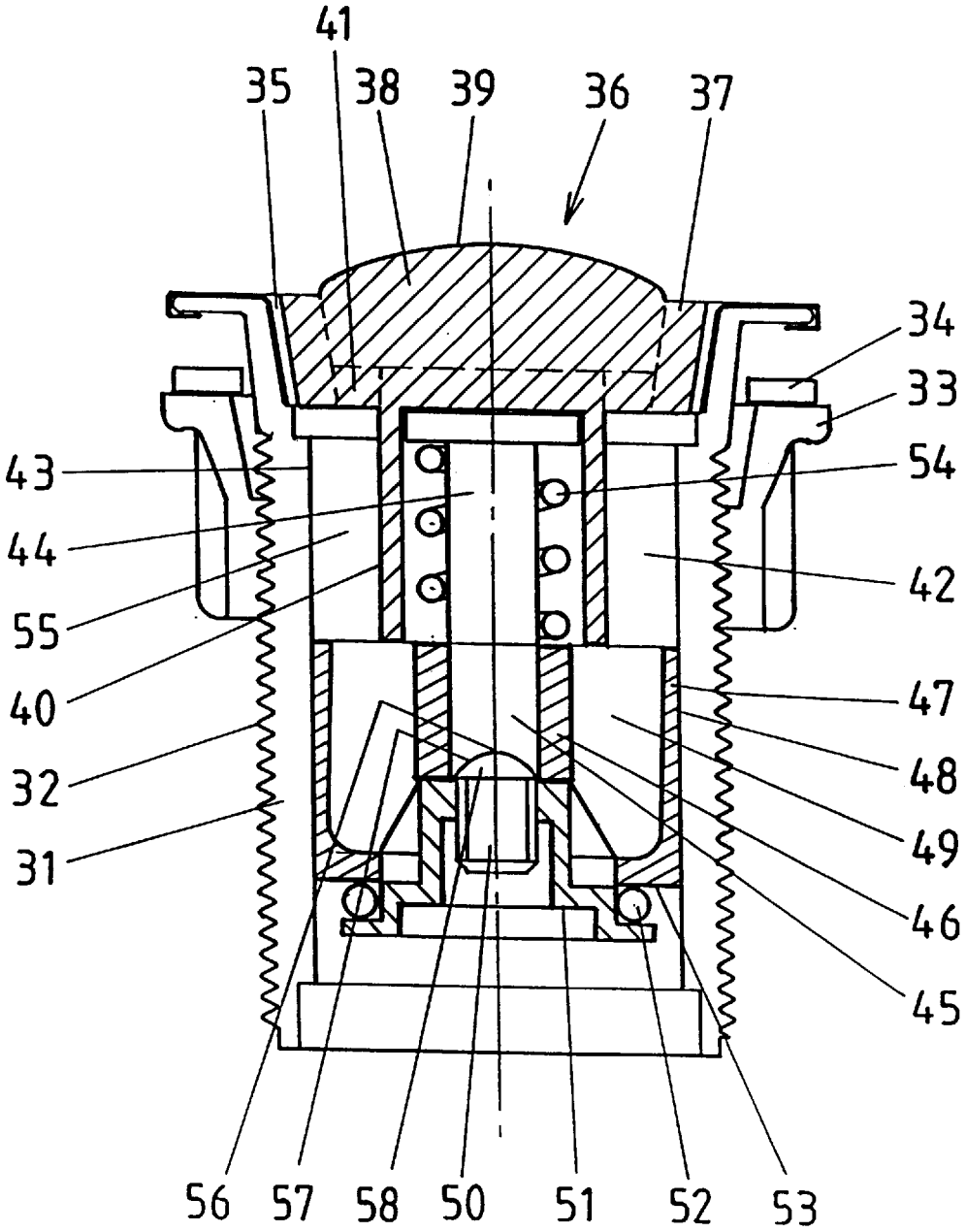
FIG. 4 shows a cross sectional view of an alternative embodiment of the invention.

FIG. 4 illustrates a further embodiment of the invention. FIG. 4 shows a cross sectional view of an alternative embodiment of the invention.

The waste plug fitting of FIG. 4 comprises a body 31 having an externally threaded portion 32 to facilitate connection to a waste conduit (not shown). A threaded collar 33 with a gasket 34 is provided for sealing engagement of the plug fitting in a bathtub, hand basin or the like (not shown).

Located in the mouth or upper opening 35 of body 31 is an apertured plug 36 comprising a circular frusto-conical outer wall 37 adapted to nest in the upper opening 35 and be rotatable therein.

Plug 36 comprises a rib 38 extending diametrically of the inner surface of wall 37. The upper edge 39 of rib 38 is curved upwardly to provide a finger grip to facilitate rotation of plug 36.

Depending from the lower surface of plug 36 is a cylindrical housing or shroud 40 which is closed at its upper end and open at its lower end. The upper end and outer wall of shroud 40 define a generally unrestricted annular aperture 41 and an annular fluid pathway 42 with the inner wall 43 of body 31.

Located within shroud 40 and secured to plug 36 is a shaft 44 rotatably journalled about boss 45 in a cylindrical wall 46 associated with a valve support member 47 releasably located within body 31. Valve support member 47 is suitably located within body 31 by frictional engagement of outer wall 48 of valve support member 47 with the inner wall surface 43 of body 31. Cylindrical wall 46 is supported within valve support member 47 by ribs 49 extending between wall 48 and wall 46 to define a generally unrestricted annular aperture therebetween.

Secured to the head 50 of shaft 44 and rotatable therewith is a valve member 51 carrying an O-ring seal 52 for sealing engagement on the undersurface of an annular rim 53 at the lower end of valve support member 47. In this embodiment, rim 53 forms a valve seat member to co-operate with the O-ring seal 52 on valve member 51 when valve member 51 is biassed against valve seat member 53 by a helical compression spring 54 located within the generally closed chamber 55 formed between shaft 44 and shroud 40.

At the lower end of wall 46 are diametrically opposed notches 56 having inwardly tapered edges 57. On the upper portion of valve member 51 are opposed lugs 58 having a shape complementary to notches 56 to permit nesting engagement therewith.

Upon rotation of plug 36 and hence rotation of shaft 44 and valve member 51, the complementary tapered edges of lugs 58 and notches 56 exert a "camming" action between wall 46 and valve member 51 to cause valve member 51 to move downwardly against the restoring influence of spring 54 to form a generally unrestricted annular aperture between the valve seat member 53 and valve member 51.

It will be readily apparent to a skilled addressee that the embodiment of FIG. 4 provides a hydrostatic valve arrangement similar to the embodiment of FIGS. 1–3 in terms of its operation and the provision of a relatively unobstructed fluid pathway when in an open position to flush away accumulated debris with a minimum of "hang up" points at which debris, lint and hair might otherwise accumulate.

Like the arrangement of FIGS. 1–3, the embodiment of FIG. 4 also permits the removal of the valve mechanism from within the waste plug body in the event that easy maintenance is required.

The various embodiments of the apparatus according to the present invention are suitable for all domestic and commercial residential properties as well as nursing homes, hospitals and the like. The apparatus also has application in public facilities, floor drainage and industrial applications.

It will be readily apparent to a skilled addressee that many modifications and variations may be made to the invention without departing from the spirit and scope thereof.

I claim:

1. A hydrostatic waste plug fitting for a drain opening in a bathtub or hand basin, said fitting comprising:

hollow body having an inlet end and an outlet end, the outlet end being adapted for connection to a waste conduit;

a valve seat member secured within said hollow body, said valve seat member defining a substantially unobstructed aperture;

a valve support member within said hollow body;

a support shaft slidably mounted in said valve support member;

a valve member attached to said support shaft;

a resilient biassing spring to urge said valve member to a normally closed position against said valve seat member; and locking means to selectively lock said valve member in an open position;

said valve member, in an unlocked condition, being movable under the influence of a predetermined hydrostatic pressure between a closed position and an open position, and movable under the influence of said biassing spring between an open position and a closed position after reduction of said predetermined hydrostatic pressure to maintain a predetermined level of liquid in the bathtub or hand basin; and said valve seat member, valve member, support shaft, valve support member and biassing spring being removable from said hollow body via said inlet end;

said waste plug fitting characterised in that when said valve member is in an open position, a substantially unobstructed fluid pathway is provided between said inlet end and said outlet end to enable debris to be flushed therethrough.

2. A hydrostatic waste plug fitting according to claim 1, wherein said biassing means is housed within a shroud member to prevent, in use, contact between said biassing means and foreign matter entering said inlet end.

3. A hydrostatic waste plug fitting according to claim 1, wherein said locking means comprises complementary tapered surfaces associated respectively with said support shaft and said valve support member whereby selective rotation of said support shaft moves said valve member between a normally closed position actuable under the influence of hydrostatic pressure thereon and a locked open position to drain said bathtub or hand basin.

4. A hydrostatic waste plug fitting according to claim 1, wherein said valve seat member is located adjacent said inlet end.

5. A hydrostatic waste plug fitting according to claim 1, wherein said valve seat member is located adjacent said outlet end.

6. A hydrostatic waste plug fitting for a drain opening in a bathtub or hand basing, said fitting comprising:

a hollow body having an inlet and outlet end, the outlet end being adapted for connection to a waste conduit;

a valve seat member secured within said hollow body, said valve seat member defining a substantially unobstructed drain aperture;

a valve support member within said hollow body;

a support shaft slidably mounted in said valve support member;

a valve member attached to said support shaft;

a resilient biassing spring to urge said valve member to a normally closed position against said valve seat member, said biassing spring being housed in a shroud means to prevent contact with foreign matter entering said hollow body via said inlet end; and locking means to selectively lock said valve member in an open position;

said valve member, in an unlocked condition, being movable under the influence of a predetermined hydrostatic pressure between a closed position and an open position, and movable under the influence of said biassing spring between an open position and a closed position after reduction fo said predetermined hydrostatic pressure to maintain a predetermined level of liquid in the bathtub or hand basin;

said valve seat member, valve member, support shaft, valve support member and biassing spring being removable from said hollow body via said inlet end; and wherein said locking means comprises tapered surfaces on said valve member and said valve support member co-operative to urge said valve member to an open position against the influence of said biassing spring when said valve member is selectively rotated relative to said valve support member.

7. An apparatus according to claim 6, wherein said locking means includes manual actuation means located at the inlet end of said hollow body, said manual actuation means being connected to said valve support shaft for selective rotation of said valve member.

8. An apparatus according to claim 6, wherein said valve member is located adjacent said inlet end.

9. An apparatus according to claim 6, wherein said valve member is located adjacent said outlet end.

* * * * *